US005150947A

United States Patent [19]

Croshaw

[11] Patent Number: 5,150,947

[45] Date of Patent: Sep. 29, 1992

[54] DUAL-TONGUE SEAT COVER ATTACHMENT

[75] Inventor: Steven P. Croshaw, Mendon, Utah

[73] Assignee: Saddleman, Inc., Logan, Utah

[21] Appl. No.: 763,221

[22] Filed: Sep. 20, 1991

[51] Int. Cl.[5] ..... A47C 31/00

[52] U.S. Cl. ..... 297/229

[58] Field of Search ..... 297/218, 219, 224, 226, 297/225, 228, 229, 382, 441

[56] References Cited

U.S. PATENT DOCUMENTS

| | | | |
|---|---|---|---|
| 1,802,104 | 8/1931 | Whaley | 297/229 X |
| 1,836,302 | 12/1931 | Bloomfield | 297/229 |
| 2,229,160 | 1/1941 | Wittcoff | 297/224 |
| 4,396,227 | 8/1983 | Neilson | 297/219 |
| 4,669,779 | 6/1987 | Kaganas et al. | 297/229 |
| 4,693,511 | 9/1987 | Seltzer et al. | 297/224 X |

FOREIGN PATENT DOCUMENTS

| | | | |
|---|---|---|---|
| 854850 | 4/1940 | France | 297/226 |
| 1511646 | 2/1968 | France | 297/219 |
| 483942 | 2/1970 | Switzerland | 297/218 |
| 431008 | 6/1935 | United Kingdom | 297/224 |

*Primary Examiner*—Peter R. Brown

*Attorney, Agent, or Firm*—Thorpe North & Western

[57] ABSTRACT

A dual-tongue seat cover fixture for use with a one-piece vehicle seat cover having a seat cover portion and a back cover portion for placement respectively over the seat cushion and separate seat back of a vehicle seat in which a transverse section of the cover lies adjacent the crevice between the seat cushion and the seat back. The fixture includes a sheet of flexible material joined along a midline to the transverse section of the cover, where the midline divides the sheet into first and second sections which extend throuch the crevice when the cover is installed on the vehicle seat. Loops, grommets, or other fastening elements are formed on the edges of the first and second sections opposite the midline for joining the first section to the seat cover portion and the second section to the back cover portion.

13 Claims, 1 Drawing Sheet

DUAL-TONGUE SEAT COVER ATTACHMENT

BACKGROUND OF THE INVENTION

This invention relates to a vehicle seat cover and more particularly to an arrangement for attaching a one-piece seat cover to a vehicle seat through the crevice thereof.

A common problem with vehicle seat covers, especially one-piece seat covers, is the tendency of those portions of the seat cover which overlie the seat cushion and the seat back to wrinkle or pucker with continued use. It has been especially difficult to prevent puckering of one-piece seat covers along that portion of the cover which lies adjacent the crevice of a vehicle seat. Although arrangements have been developed for attaching such seat covers to either the seat frame or other parts of the seat cover through the crevice, the problem of puckering has remained.

SUMMARY OF THE INVENTION

It is an object of the invention to provide a new and improved vehicle seat cover construction for installing on a vehicle seat in which the seat cushion is separate from the seat back.

It is also an object of the invention to provide such a seat cover construction in which the seat cover may be installed to be substantially free of the typical wrinkling or puckering of those portions of the seat cover which overlie the seat cushion and seat back.

It is a further object of the invention to provide a vehicle seat cover attachment design which, when the seat cover is installed, serves to uniformly pull toward the crevice of the vehicle seat that portion of the seat cover lying adjacent to the crevice.

It is an additional object of the invention to provide such a seat cover and seat cover attachment design which may be quickly and easily installed on and removed from a vehicle seat.

The above and other objects of the invention are realized in a specific illustrative embodiment of a vehicle seat cover which includes a seat cushion panel formed to fit over the seat cushion portion of a vehicle seat, and a seat back panel formed to fit over the seat back portion of a vehicle seat, wherein the seat cushion panel and seat back panel share a common transverse locus which lies adjacent the junction between the seat cushion portion and seat back portion of the vehicle seat, when the cover is installed on the vehicle seat. Also included are first and second flexible tongues or sheets joined at respective side edges to the common locus of the seat cushion panel and seat back panel to extend rearwardly thereof through the junction of the vehicle seat. A first attachment mechanism is formed generally on the edge of the first sheet opposite the first sheet's respective side edge for joining the sheet to the seat cushion panel. A second attachment mechanism is formed generally on the edge of the second sheet opposite the second sheet's respective side edge for joining the second sheet to the seat back panel.

When installed, the dual-tongue attachment arrangement pulls generally uniformly on the common transverse locus to urge it toward and partway through the junction between the seat cushion portion and the seat back portion of the vehicle seat and thereby substantially eliminate wrinkles and puckering which typically occur with other attachment arrangements.

BRIEF DESCRIPTION OF THE DRAWINGS

The above and other Objects, features and advantages of the invention will become apparent from a consideration of the following detailed description presented in connection with the accompanying drawings in which.

DETAILED DESCRIPTION

Figure 1:
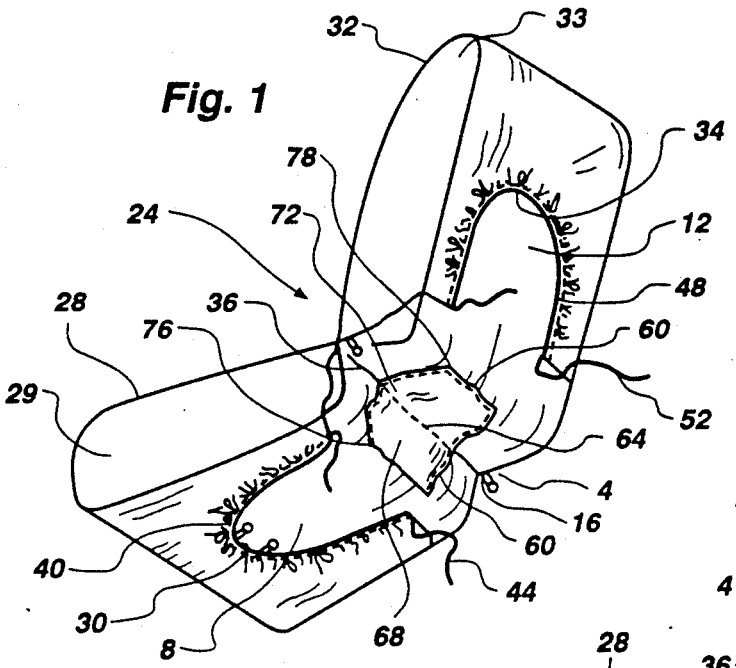
FIG. 1 shows a bottom, rear, perspective view of a vehicle seat cover made in accordance with the principles of the present invention and mounted on a vehicle seat.

Referring to the drawings, there is shown a conventional vehicle seat 4 (FIGS. 1 and 2) having a seat cushion part 8 and a seat back part 12, with a junction, joint or crevice 16 therebetween. The vehicle seat 4 of FIGS. and 2 is conventionally used in both automobiles and trucks. The primary feature of interest in the vehicle seat 4 as regards the present invention is that the seat has an opening at the junction 16 between the seat cushion 8 and seat back 12, for reasons which will be evident momentarily. The vehicle seat shown is a bucket seat, but it should be understood that the seat cover of the present invention could also be used with vehicle bench seats having a seat cushion, seat back, and crevice therebetween.

Figure 2:
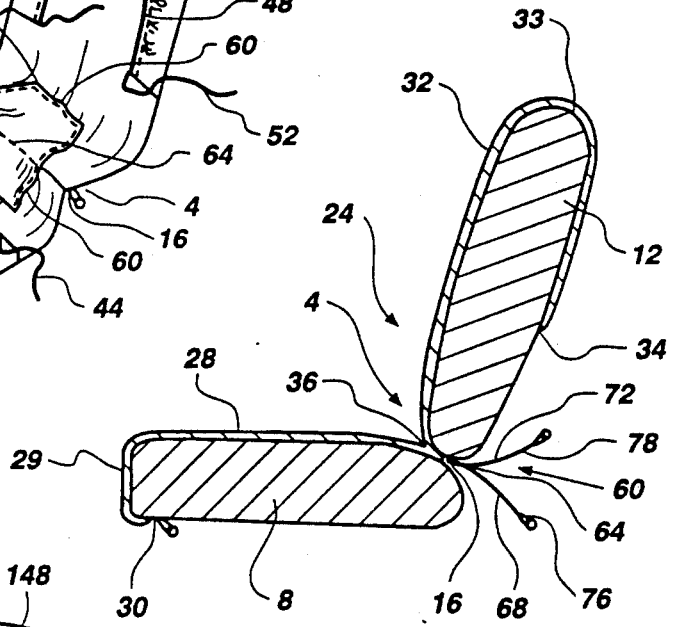
FIG. 2 is a side, elevational, cross-sectional view of the vehicle seat cover of FIG. 1.

Also shown in FIGS. and 2 is one illustrative embodiment of a seat cover 24 made in accordance with the invention. The seat cover 24 includes a top panel 28 formed to overlie the top of the seat cushion 8. A flexible and elastic sheet of material 29 is attached at an upper edge to the front and side edges of the top panel 28 to extend downwardly about the sides and front of the seat cushion 8 and partially underneath the seat cushion as shown. The sheet of material 29 terminates in a bottom, U-shaped edge 30 which is open rearwardly of the seat cushion part 8. The seat cushion panel 28 could be formed from a piece of material separate from the sheet of material 29, as shown in FIGS. 1 and 2, or it could be formed from a single sheet of material in which case the panel would simply extend down over the sides and front of the seat cushion 8 to terminate in the bottom edge 30. Still, alternatively, the panel 28 could be formed from a single piece of material, and then front and side panels to overlie the front and sides of the seat cushion 8 could be formed, with a separate underneath sheet which terminates in the bottom edge 30 attached to the lower edges of the front and side panels. The fastening system for that portion of the seat cover 24 which covers the seat cushion 8 will be discussed momentarily.

The seat cover 24 also includes a seat back panel 32 joined to the seat cushion panel 28 along a common transverse locus of points 36. The front panel 32 is formed to overlie the front surface of the seat back 12. A flexible and elastic sheet of material 33 is joined at a forward edge to the upper and side edges of the front panel 32 to extend about the sides and top of the seat back 12 and partly over the rear of the seat back, as shown. The sheet of material 33 terminates at the rear of the seat back 12 in an inverted U-shaped edge 34, as best seen in FIG. 1. Again, the front panel 32 may be made of a separate piece of material from the sheet of material 33 or alternatively the two may be formed of a single sheet capable of extending from the front of the seat back 12 about the sides and top of the seat back to the rear thereof. Still, alternatively, the front panel 32 may be made from a single piece of material, while separate side panels and a top panel are formed to join the side edges and upper edge respectively of the front panel, and then a separate sheet formed to partially cover the rear of the seat back 12 and joined to the rear edges of the side and top panels. Likewise, the seat cushion top panel 28 and seat back front panel 32 may be formed from a single piece of material or from separate pieces joined together to form a one-piece seat cover.

Formed in the bottom edge 30 of the sheet of material 29 is a channel 40 having a tunnel or passageway for receiving and holding an elastic tether or drawstring 44. Likewise, the rear edge 34 of the sheet of material 33 includes a channel 48 having a tunnel or passageway for receiving and holding an elastic drawstring 52. As will be explained later, the drawstrings 44 and 52 are used for securing the seat cover 24 onto the vehicle seat 4.

A dual-tongue attachment fixture of the present invention includes a rectangular, flexible sheet of material 60 folded along a midline 64 and joined at the midline to the transverse locus of points 36 of the seat cover 24. Folding the sheet of material 60 at the midline 64 defines the sheet as having a first section 68 and a second section 72, both of which extend rearwardly of the seat cover 24 and through the junction 16 between the seat cushion 8 and seat back 12 when the seat cover is installed on the vehicle seat 4 (best seen in FIG. 2). The two sections 68 and 72 have substantially the same dimensions with the contiguous edges thereof being substantially coextensive and conterminous. The sheet 60 is joined at its midline 64 along a substantial portion of the length of the transverse locus of points 36 to provide a fairly uniform force on the seat cushion panel 28 and seat back panel 32, when the seat cover 24 is installed on the vehicle seat 4. The sheet 60 may be made of a single piece of material folded at the midline 64, as described, or from two separate sheets or sections joined at respective edges to one another and to the transverse locus of points 36. The sheet 60 may be made of a sturdy cloth, leather or imitation leather or like flexible material.

Formed on the corners of the sections 68 and 72 opposite the midline 64 are loops 76 and 78 for use in coupling or tying to the drawstrings 44 and 52 respectively. For example, the loops 76 of the section 68 could illustratively be tied to respective ends of the drawstring 44 to secure the top panel 28 on the seat cushion 8. Similarly, the loops 78 of section 72 could illustratively be coupled or tied to respective opposite ends of the drawstring 52 to secure the front panel 32 on the seat back 12. By cinching or pulling the drawstrings 44 and 52 and then tying or joining them to the sections 68 and 72 respectively, the drawstrings each form continuous loops with respective sections, and the seat cushion top panel 28 and seat back front panel 32 are pulled smoothly, and uniformly over the seat cushion 8 and seat back 12 respectively. In effect, the continuous loop configurations of the drawstrings 44 and 52 pull uniformly the bottom edge 30 and rear edge 34 to gather the sheets of material 29 and 33 at least partially along the respective edges and this, in turn, applies a substantially uniform pulling force on the top panel 28 and front panel 32 as desired. The dual-tongue sheet 60 also pulls uniformly against the transverse locus of points 36 to pull the locus toward and partway through the junction 16 and, because it is attached along the midline 64 over a substantial length of the locus 36, the pulling force is supplied and distributed uniformly to the seat cover 24 to yield a substantially pucker-free fit of the seat cover over the vehicle seat 4.

Figure 3:
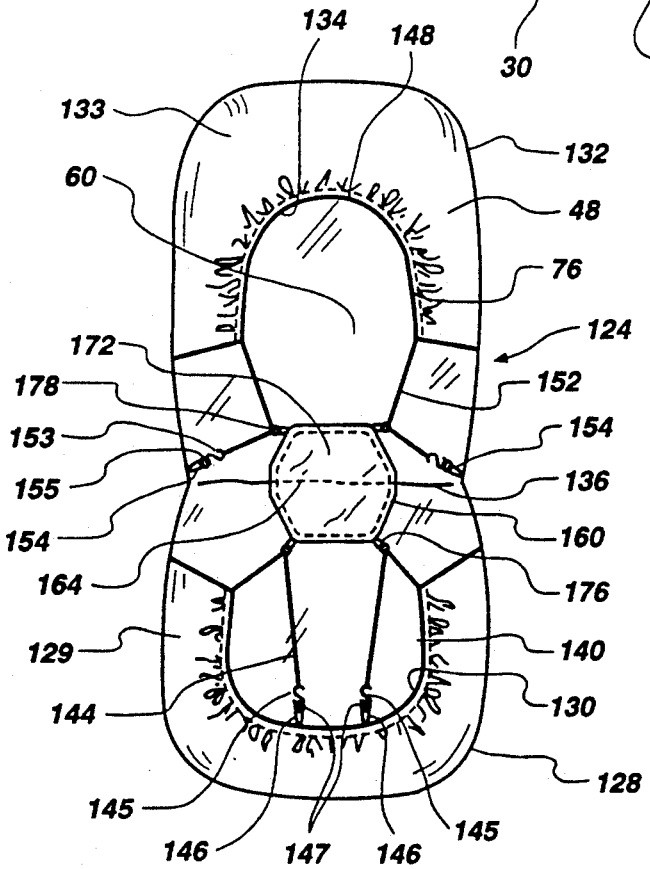
FIG. 3 is a rear view of another embodiment of an uninstalled vehicle seat cover made in accordance with the present invention.

FIG. 3 shows a rear, bottom view of a seat cover 124 similar in construction to seat cover 24 of FIGS. 1 and 2, but having a different fastening system. The seat cover 124 includes a top panel 128 and a downwardly extending sheet of material 129 which terminates in a bottom U-shaped edge 130 having a channel 140 formed therein. Disposed in the channel 130 is an elastic drawstring 144, on the ends of which are fastened hooks 145. Attached to the bottom edge 130 of the sheet of material 129 at spaced-apart locations forwardly of the top panel 128 are a pair of loops 146 which are looped about D-rings 147.

The seat cover 124 also includes a front panel 132 for overlaying the front of a seat back and a flexible and elastic sheet of material 133 extending rearwardly from the top and side edges of the front panel to terminate in a rear inverted U-shaped edge 134. Formed in the rear edge 134 is a channel 148 for receiving and holding an elastic drawstring 152, as with the seat cover 24 of FIGS. 1 and 2. Attached to the ends of the drawstring 152 are hooks 153. Attached on opposite sides of the front panel 132, near the common locus 136 between the front panel 132 and top panel 128 are loops 154, in which are secured D-rings 155.

A dual-tongue sheet 160 is attached along its midline 164 to the common locus of points 136 between the front panel 132 and top panel 128, again generally as in the case of the seat cover of FIGS. 1 and 2. The dual-tongue sheet 160 in the embodiment of FIG. 3, however, includes eyelets or grommets 176 and 178 located in the corners of the sheet opposite the midline 164. The grommets 176 and 178 are provided to allow insertion therethrough of drawstrings 144 and 152 respectively so that hooks 145 and 153 may be hooked on respective D-rings 147 and 155, as shown in FIG. 3.

with the fastening system embodiment of FIG. 3, the drawstrings 144 and 152, when cinched or pulled in their respective channels and hooked to respective D-rings, form continuous loops to pull uniformly along the bottom edge 130 and rear edge 134 to provide a uniform force pulling on top panel 128 and front panel 132 to substantially eliminate wrinkles and puckering.

Although specific fastening arrangements are shown in FIGS. 1–3, it should be understood that a variety of other arrangements might be provided for securing the seat cushion top panel (28 and 128) and seat back front panel (32 and 132) to the vehicle seat. For example, the drawstrings carried by the U-shaped channels could be secured directly to the vehicle seat or to other parts of the seat cover other than the dual-tongue sheet (60 and 160) shown in the drawings. Also, the U-shaped channels with drawstrings could be employed in two-piece seat covers where, for example, the section 68 of the dual-tongue sheet 60 (FIGS. 1 and 2) constitutes an extension of the top panel 28 and is not joined to the section 72. In such case, the section 68 would simply be joined to the drawstring 44 as shown in FIG. 1 or as shown in FIG. 3. The section 72 of the dual-tongue sheet 60 could then be formed to simply constitute an extension of the front panel 32 and be joined directly to the drawstring 52. Also, although the dual-tongue sheet 60 (FIGS. 1 and 2) and 160 (FIG. 3) is shown as having loops or grommets, the dual-tongue sheet could be formed with tethers or other fastening elements in place of the loops and grommets for joining to the drawstrings or other fastening elements attached to the bottom and rear edges of the seat cushion cover and seat back cover.

It is to be understood that the above-described arrangements are only illustrative of the application of the principles of the present invention. Numerous modifications and alternative arrangements may be devised by those skilled in the art without departing from the spirit and scope of the and the appended claims are intended to cover such modifications and arrangements. For example, although bucket seat covers were shown, the dual-tongue attachment could also be used with bench seat covers.

What is claimed is:

1. A vehicle seat cover comprising a seat cushion panel formed to fit over the seat cushion portion of a vehicle seat, a seat back panel formed to fit over the seat back portion of a vehicle seat, said seat cushion panel and seat back panel joined along a common transverse locus which lies adjacent the junction between the seat cushion portion and seat back portion of the vehicle seat when the cover is installed on the vehicle seat, first and second flexible sheets jointed one above the other at respective contiguous forward edges to said common locus of the seat cushion panel and seat back panel to extend rearwardly thereof through the junction of the vehicle seat, first means formed generally on a rear edge of the first sheet opposite the sheet's respective forward edge for coupling the first sheet to the seat cushion panel to secure the panel in place on the seat cushion portion of the vehicle seat, and second means formed generally on a rear edge of the second sheet opposite the sheet's respective forward edge for coupling the second sheet to the seat back panel to secure the panel in place on the seat back portion of the vehicle seat.

2. A vehicle seat cover as in claim 1 wherein said first and second sheets have substantially the same dimensions, with contiguous edges thereof being substantially coterminous.

3. A vehicle seat cover as in claim 1 wherein said respective forward edges of the first and second sheets are joined together, as well as to said common locus.

4. A vehicle seat cover as in claim 3 wherein said first and second sheets are formed of a single sheet.

5. A vehicle seat cover as in claim 1 wherein said respective forward edges of the first and second sheets are joined to said common locus along a substantial portion of its length.

6. A vehicle seat cover as in claim 1 wherein said first and second means each comprises at least a pair of fasteners spaced apart along the rear edge of the respective sheet.

7. A vehicle seat cover as in claim 6 wherein said first and second sheets are generally rectangular, wherein said respective forward edges comprise one side of the rectangular sheets, and wherein the fasteners are formed at the corners of the sheets at said rear edges.

8. A vehicle seat cover as in claim 7 wherein the fasteners comprise grommets.

9. A vehicle seat cover as in claim 7 wherein the fasteners comprise loops.

10. In combination in a one-piece vehicle seat cover having a seat cover portion and a back cover portion for placement respectively over the seat cushion and separate seat back of a vehicle seat in which the seat cushion and seat back are separated by a crevice therebetween, so that a transverse section of the cover lies adjacent the crevice, a dual-tongue fixture comprising a sheet of flexible material joined along a midline to the transverse section, said midline dividing the sheet into first and second sections which extend through the crevice when the cover is installed on the vehicle seat, first means for attaching the first section to the seat cover portion so that the first section extends about the rear of the seat cushion, and second means for attaching the second section to the back cover portion so that the second section extends under the bottom of the seat back.

11. A fixture as in claim 10 wherein said sheet of material is generally rectangular, wherein the midline is generally parallel with first and second edges of the sheet, and wherein the first and second attaching means each comprises a pair of connectors formed at the corners of the first and second sections respectively located opposite the midline.

12. A fixture as in claim 11 wherein the connectors are grommets.

13. A fixture as in claim 11 wherein the connectors are loops.

* * * * *